US011835316B1

(12) United States Patent
Sipos

(10) Patent No.: US 11,835,316 B1
(45) Date of Patent: Dec. 5, 2023

(54) REVOLVER-TYPE FIREARM WITH A BARREL-CYLINDER GAP SEAL

(71) Applicant: David L. Sipos, Youngsville, LA (US)

(72) Inventor: David L. Sipos, Youngsville, LA (US)

( * ) Notice: Subject to any disclaimer, the term of this patent is extended or adjusted under 35 U.S.C. 154(b) by 0 days.

(21) Appl. No.: 18/189,644

(22) Filed: Mar. 24, 2023

(51) Int. Cl.
*F41A 3/76* (2006.01)
*F41A 3/14* (2006.01)
*F41C 3/14* (2006.01)

(52) U.S. Cl.
CPC . *F41A 3/76* (2013.01); *F41C 3/14* (2013.01)

(58) Field of Classification Search
CPC ..... F41A 3/74; F41A 3/76; F41C 3/14
USPC ..... 42/59, 62
See application file for complete search history.

(56) References Cited

U.S. PATENT DOCUMENTS 1,965,637 A * 7/1934 Frederich ..... F41C 3/14 42/59
2,801,573 A * 8/1957 Herlach ..... F41A 3/76 89/13.05
3,159,938 A 12/1964 Treat et al.
3,768,362 A * 10/1973 Grimm ..... F41A 3/76 89/26
4,793,084 A 12/1988 Beltzer
4,918,850 A 4/1990 Rick
5,020,258 A 6/1991 Rick
9,453,696 B2 * 9/2016 Tusting ..... F41A 13/06

FOREIGN PATENT DOCUMENTS

GB 190915753 A * 2/1910 ..... F41A 3/76

* cited by examiner

*Primary Examiner* — Bret Hayes

(57) ABSTRACT

A revolver-type firearm has a barrel-cylinder gap created between its barrel and a rotatable cartridge cylinder. The cartridge cylinder has a plurality of cartridge chambers each with corresponding counterbore retaining a translatable shuttle. When a cartridge is fired, the shuttle expands and translates forward toward the breech-end of the barrel and seals the barrel-cylinder gap to prevent the escape of gases, flames, and residue through the barrel-cylinder gap. When pressure drops as the cartridge projectile exits the barrel, the shuttle contracts. The barrel-cylinder gap opens upon rotation of the cartridge cylinder as the shuttle translates away from the breech-end of the barrel. The shuttle has a thin cylindrical body, a beveled front end, and a conical central bore and is manufactured from a hard elastic metal or metal alloy such as one comprising titanium.

8 Claims, 4 Drawing Sheets

REVOLVER-TYPE FIREARM WITH A BARREL-CYLINDER GAP SEAL

FIELD OF INVENTION

This invention relates to revolver-type firearms, and more particularly, to a revolver-type firearm that effectively seals the barrel-cylinder gap present in such revolver-type firearms.

BACKGROUND OF THE INVENTION

A revolver-type firearm, hereinafter called a revolver, is known for its reliability and accuracy. A revolver is typically comprised of a frame that supports a grip or handle, a rotatable cylinder, and a rifled barrel having a forward bore-end and a rearward breech-end. The cartridge cylinder has a forward end, a rearward end, a central cylinder bore, and a plurality of radially arrayed cartridge chambers. A shaft or quill inserted through the central cylinder bore serves as an axis of rotation about which the cartridge cylinder is rotated. The cartridge chambers are sized to receive and retain a corresponding ammunition cartridge comprised of a cartridge casing, a powder charge, a projectile typically made of lead, lead alloys, copper, or other metals, and a primer. Each ammunition cartridge is inserted into the cartridge chamber from the rearward end of the cartridge cylinder.

The cartridge cylinder is rotatably positioned within the frame with the forward end of the cartridge cylinder adjacent the breech-end of the barrel. A space, called the barrel-cylinder gap, is created between the forward end of the cartridge cylinder and the adjacent breech-end of the revolver barrel. This barrel-cylinder gap, generally in the range of about 0.002 to about 0.009 inches, serves to allow unimpeded rotation of the cartridge cylinder within the frame. An internal linkage, in association with a trigger mechanism, such as a pawl and ratchet mechanism, is used to rotate the cartridge cylinder to sequentially align the cartridge chambers and associated ammunition cartridges with the breech-end of the barrel and release a hammer or firing pin to fire the revolver. Sequential rotation of the cartridge cylinder by the internal linkage and trigger mechanism aligns succeeding cartridge chambers and associated ammunition cartridges with the breech-end of the barrel breech for repeated firing of the revolver. When the revolver is fired, the cartridge primer produces a flame that ignites the cartridge powder. The ignited powder creates hot gases and flames which create pressure within the ammunition cartridge casing to push the projectile from the cartridge casing through the revolver barrel. The hot gases and flames produced by the ignited powder also create a gritty residue of projectile particles and spent powder.

While the majority of the gases, flames, and gritty residue produced by a fired cartridge escape the revolver through the bore-end of the barrel, a portion of these gases, flames, and gritty residue escapes from the barrel-cylinder gap. The escaping gases, flames, and gritty residue from the barrel-cylinder gap exacerbate the noise created when a revolver is fired, and this exacerbated noise increases the risk of hearing loss to revolver users and immediate bystanders. The escaping gases, flames, and gritty residue from the barrel-cylinder gap also create a risk of burns to a revolver user and to immediate bystanders.

The gritty cartridge residue produced by a fired cartridge frequently collects in the barrel-cylinder gap when a revolver is fired. The collected gritty residue will in time impede cartridge cylinder rotation. Consequently, frequent maintenance is required to remove the collected gritty residue from the barrel-cylinder gap to maintain the function of a revolver and prevent firearm failure.

The escaping gases from the barrel-cylinder gap also bleeds pressure from the barrel which reduces the velocity of the cartridge projectile as the projectile moves through the barrel and therefore impedes the ballistics of the projectile and the performance of the revolver. Escaping gases from the barrel-cylinder gap will also degrade the effectiveness of a barrel noise or sound suppressor when such a device is being utilized.

Escaping gases and flames from the barrel-cylinder gap also create a bright flash of light. When a revolver is used at night or in an unlight room, this flash of light can create temporary flash blindness in a revolver user. This flash blindness creates a hazard to a user and to others as a user may be temporality unable to properly identify a target or recognize a threat.

Escaping gases and flames from the fired cartridge cylinder through the barrel-cylinder gap may erode or "flame-cut" the revolver frame which will in turn increase the wear and tear on the firearm and ultimately reduce its service life.

Consequently, there is a need for a revolver that effectively seals the barrel-cylinder gap inherent in revolver-type firearms in order to reduce the escape of gases and flames created when such a firearm is fired.

There is a further need for a revolver that effectively seals the barrel-cylinder gap inherent in revolver-type firearms in order to allow for reliable rotation of the cartridge cylinder within the frame.

There is still a further need for a revolver that effectively seals the barrel-cylinder gap inherent in revolver-type firearms in order to reduce the firing noise created during use of such a firearm.

There is also a need for a revolver that effectively seals the barrel-cylinder gap inherent in inherent in revolver-type firearms in order to reduce barrel pressure losses and enhance firearm performance.

There is also a need for a revolver that effectively seals the barrel-cylinder gap inherent in revolver-type firearms in order to enhance suppressor performance when such sound suppressor devices are being utilized.

There is also a need for a revolver that effectively seals the barrel-cylinder gap inherent in revolver-type firearms in order to reduce the frequency of firearm maintenance and cleaning as well as to reduce wear and tear on the firearm and to extend its service life.

There is also a need for a revolver that effectively seals the barrel-cylinder gap inherent in revolver-type firearms in order to reduce the flash of light caused by firing the revolver and the incidences and severity of temporary flash blindness in the user of a revolver.

SUMMARY OF THE INVENTION

The present invention provides an improved revolver having a barrel-cylinder gap closing mechanism designed to address the aforementioned needs. The barrel-cylinder gap closing mechanism is comprised of a translatable tubular shuttle provided at the forward end of each cartridge chamber of the cartridge cylinder of the improved revolver adjacent the breech-end of the revolver barrel. The translatable shuttle translates and expands within the cartridge cylinder counterbore in response to pressure created when a cartridge is fired to momentarily seal the barrel-cylinder gap. The translatable shuttle is manufactured from a thin, hard, elastic metal or metal alloy and has a cylindrical body having a conical central bore at its rearward end and a beveled front face at its forward end configured to correspond with and engage the barrel leade at the breech-end of the revolver barrel.

When the improved revolver is fired, the expanding gases from the fired ammunition cartridge creates pressure within the counterbore of the cartridge chamber of the improved cartridge cylinder. This pressure instantly expands the translatable shuttle radially outward against the counterbore and translates the shuttle forward tightly against the barrel leade of the revolver barrel. The expansion and translation of the shuttle provides a positive seal of the barrel-cylinder gap between the forward end of the improved cartridge cylinder and the breech-end of the revolver barrel. This positive seal of the barrel-cylinder gap will immediately impede the escape of gases, flames, and gritty residue from the barrel-cylinder gap. Because of its elastic properties, the translatable shuttle instantly contracts to its original size as the pressure created from firing the ammunition cartridge drops as the projectile exits the revolver barrel. Rotation of the improved cartridge cylinder will engage the translatable shuttle with the barrel leade. This engagement will push or cam the translatable shuttle rearward to open the barrel-cylinder gap to allow the cartridge cylinder to rotate freely within the frame for a subsequent firing.

It is thought that titanium, a titanium alloy, or another metal or metal alloy with elastic and hardness properties similar to titanium will be used in the manufacture of the shuttle.

These drawings omit features that are well established in the art and do not bear upon points of novelty are also omitted in the interest of descriptive clarity. Such features include bushings, threaded junctures, weld lines, pins, and brazed junctures.

DETAILED DESCRIPTION OF THE INVENTION

Figure 1:
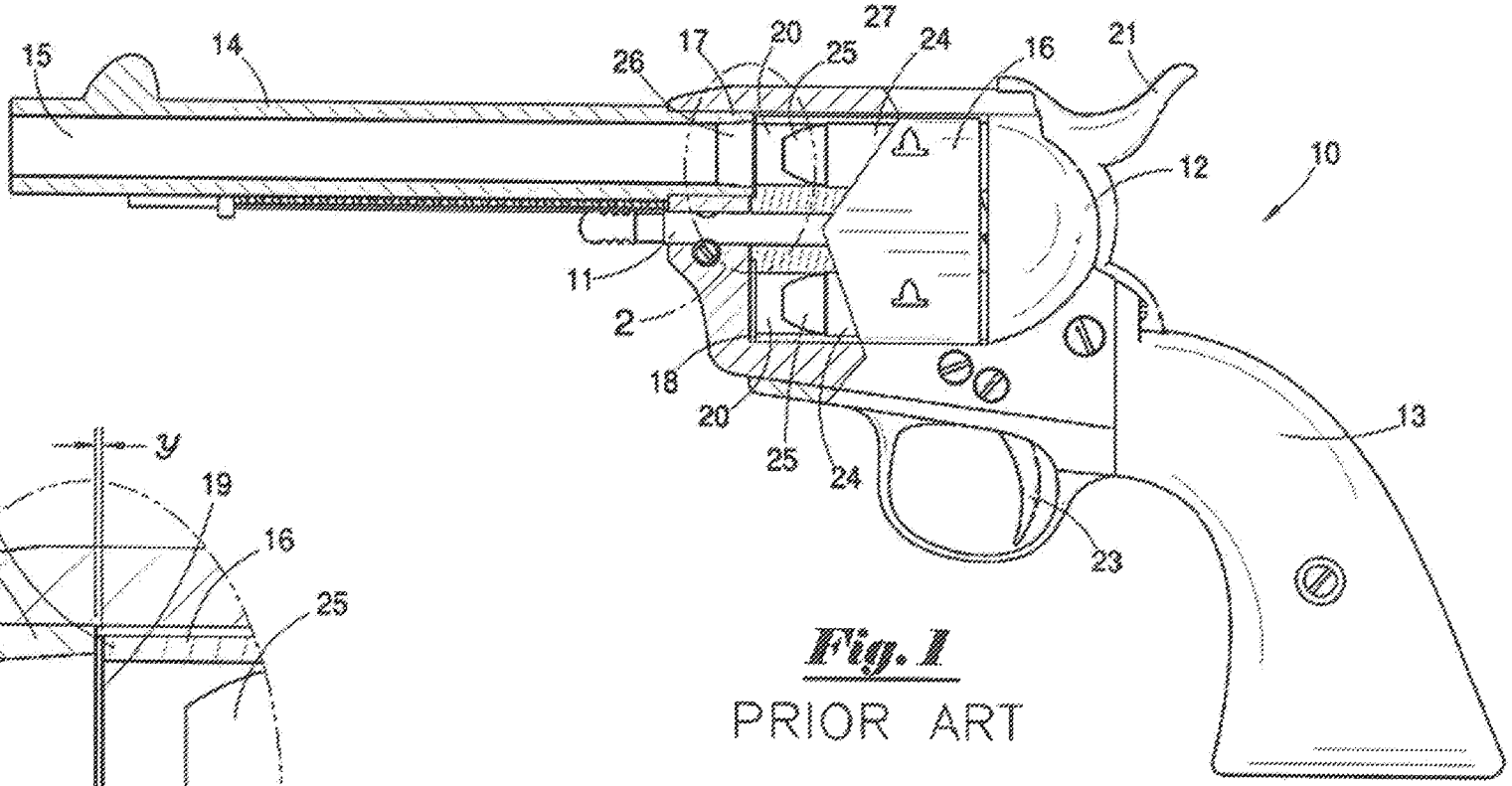
Fig. 1 PRIOR ART
FIG. 1 is a partial cross-section side view showing the features of a typical prior art revolver.

FIG. 1 shows the configuration of a typical prior art revolver-type firearm (10). As shown in FIG. 1, a partial cross-section side view, the revolver-type firearm (10) has a frame (12) with a handle or grip (13), a barrel (14) having a barrel bore (15) with a breech-end (17) having a conical forcing cone or leade (26), a cartridge cylinder (16) rotatable about a cylinder center pin (11), a hammer (21), and trigger (23). The barrel (14) is shown threadedly attached or otherwise mounted to the frame (12) at its rearward or breech-end (17). The cartridge cylinder (16) is encompassed within the frame (12) and has a cylinder forward end (18) adjacent to the breech-end (17) of the barrel (14).

The cartridge cylinder (16) also has a plurality of radially arrayed cartridge chambers (20). Each of the cartridge chambers (20) is configured to retain an ammunition cartridge (24) having a projectile (25) and a cartridge casing (27) that retains a propellant powder charge and a primer which are not shown.

The revolver (10) also has an operating mechanism or action typically comprised of an internal linkage and firing pin, not shown, in association with the cartridge cylinder (16), hammer (21), and trigger (23) for controlling the rotation and placement of the cartridge cylinder (16) and the alignment of the cartridge chambers (20) and ammunition cartridge (24) for firing the revolver (10).

Figure 2:
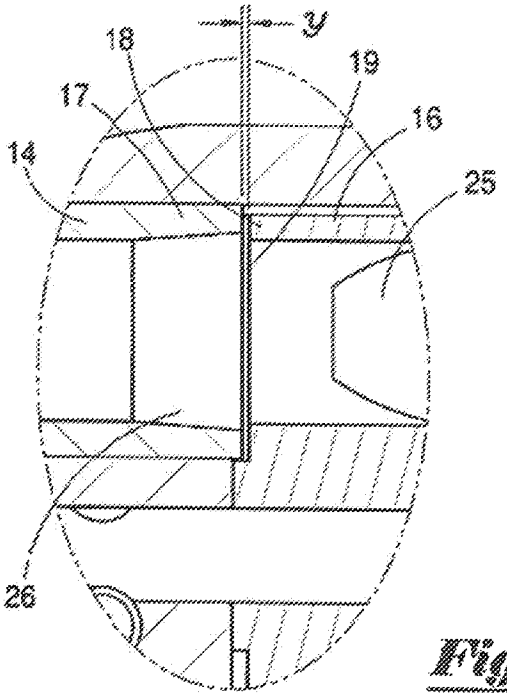
Fig. 2 PRIOR ART
FIG. 2 shows detail 2 from FIG. 1, a partial cross-section side view of the typical prior art revolver illustrating the barrel-cylinder gap between the breech-end of the barrel and the cartridge cylinder.

FIG. 2, an enlarged detail side view designated as Detail 2 in FIG. 1, shows the breech-end (17) of the barrel (14), barrel forcing cone or leade (26), the forward end (18) of the cartridge cylinder (16), and the barrel-cylinder gap (19), i.e., a space (y), allowing unrestricted rotation of the cartridge cylinder (16) with respect to the barrel (14) during operation of the firearm (10). The forcing cone or leade (26) at the breech-end of the barrel receives and centers the projectile (25) from the ammunition cartridge (24) when a cartridge (24) is fired. While the barrel-cylinder gap (19) is provided to allow for unrestricted rotation of the cartridge cylinder (16), it also allows a portion of the gases, flames, and cartridge residue generated by the propellant powder and primer to escape through barrel-cylinder gap (19) when the ammunition cartridge (24) is fired.

Escaping gases, flames, and cartridge residue through the barrel-cylinder gap (19) exacerbate the risk of burns to the revolver users and immediate bystanders. Escaping gases, flames, and cartridge residue through the barrel-cylinder gap (19) also exacerbate the firing noise created when the ammunition cartridge (24) is fired. The exacerbated firing noise enhances the risk of hearing loss to the revolver users and immediate bystanders. Escaping gases, flames, and cartridge residue through the barrel-cylinder gap (19) also degrade the pressure in the barrel (14) and the velocity of a cartridge projectile (25) as the cartridge projectile (25) moves through the barrel (14) after firing. Escaping gases, flames, and cartridge residue through the barrel-cylinder gap (19) also create a gritty residue in the barrel-cylinder gap (19) that will impede the efficiency of the rotation of the cartridge cylinder (16).

An embodiment of the improved revolver (100) is shown in FIGS. 3-6. The improved revolver (100) shown in FIG. 3 will have the same components as those of the conventional revolver (10) shown in FIG. 1. These components include the frame (12) with a handle or grip (13), the barrel (14) with a breech-end (17) and a leade (26) tapered at a desired angle β, the cartridge cylinder center pin (11), the hammer (21), the trigger (23), and the operating mechanism or firing action comprised of an internal linkage and firing pin, not shown. However, the improved revolver (100) is provided with a barrel-cylinder gap closing assembly (102) comprised of an improved cartridge cylinder (116) and a plurality of translatable shuttles (140).

The improved cartridge cylinder (116) has a forward end (118) and a rearward end (120) of the barrel-cylinder gap closing assembly (102) and will be encompassed within the frame (12). The improved cartridge cylinder (116) will be rotatable about cylinder center pin (11) and will have a plurality of radially arrayed cartridge chambers (20) extending forward from the rearward end (120) of the improved cartridge cylinder (116). Each cartridge chamber (20) is configured to hold an ammunition cartridge (24) with a propellant powder charge, a primer, and a projectile (25) as described herein above. However, each cartridge chamber (20) of the improved cartridge cylinder (116) will have a corresponding counterbore (131) that is coaxial with and forward of its corresponding cartridge chamber (20). Each of the counterbores (131) are configured to hold and retain a translatable coaxial shuttle (140).

Figure 4:
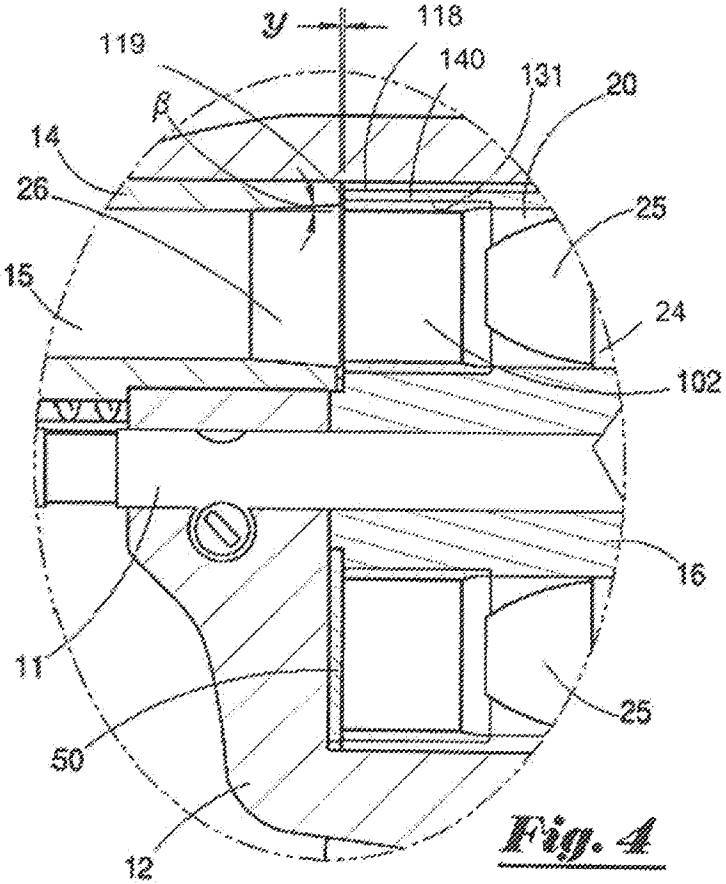
FIG. 4, designated as Detail 4 in FIG. 3, is a partial cross-section view of the improved cartridge cylinder and adjacent breech-end of the revolver barrel, illustrating the barrel-cylinder gap and the barrel-cylinder gap closing mechanism of the improved revolver shown in FIG. 3.
Figure 6:
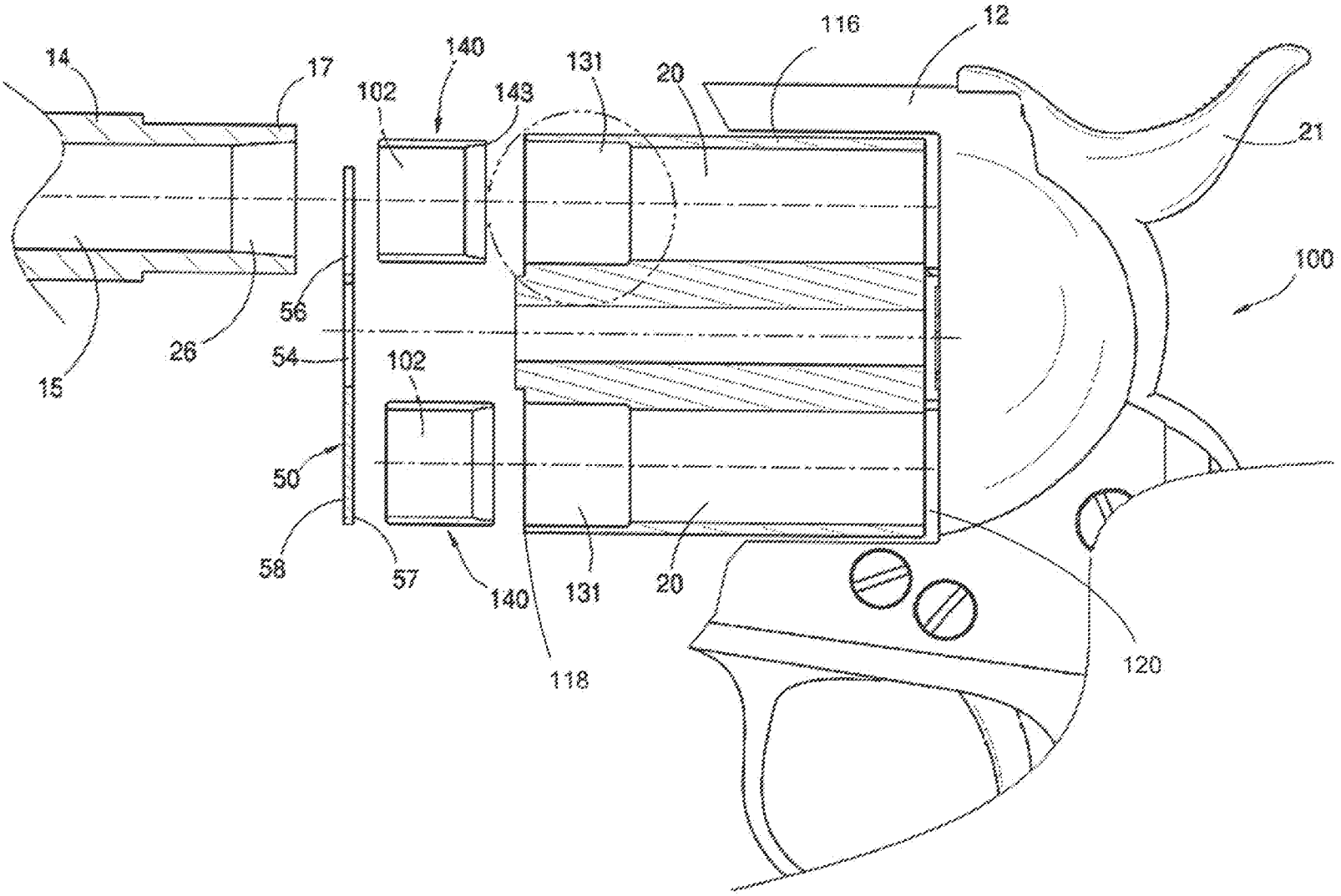
FIG. 6 is a cross-section view of the improved cartridge cylinder of the improved revolver of FIG. 3 showing an exploded view of the barrel-cylinder gap closing mechanism.
Figure 7:
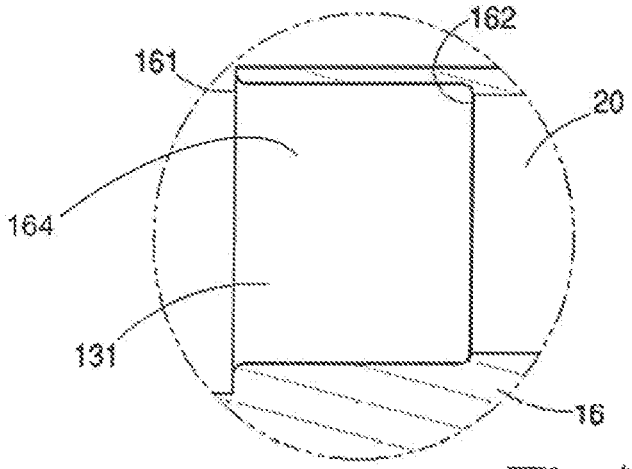
FIG. 7 is a partial cross-section view of the forward of a cartridge chamber of the improved cartridge cylinder of the improved revolver shown in FIG. 3 illustrating the cartridge chamber counterbore.

Each counterbore (131), as shown more clearly in FIG. 4 and FIG. 6, extends rearward from the forward end (118) of the improved cartridge cylinder (116) to its corresponding cartridge chamber (20). FIG. 7 is a partial longitudinal cross-section view of the improved cartridge cylinder (116) of the barrel-cylinder gap closing assembly (102) showing a counterbore (131) coaxial to and forward of its corresponding cartridge chamber (20) of the improved cartridge cylinder (116). Each counterbore bore (131) has a rearward end (162) adjacent to the coaxial corresponding cartridge chamber (20) in the cartridge cylinder (116), a forward end (161) at the forward end (118) of the cartridge cylinder (116), and an interior cylindrical counterbore wall (164).

Figure 8:
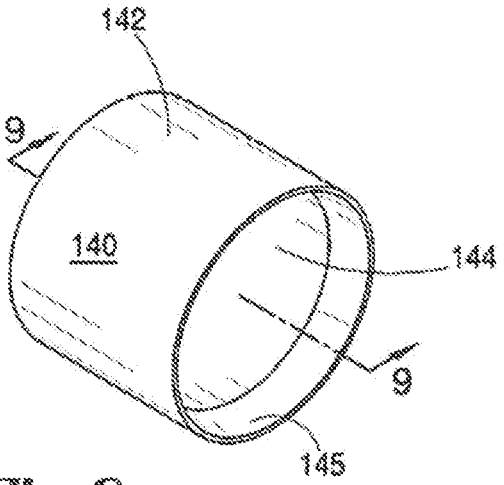
FIG. 8 is an isometric view of the translatable shuttle of the barrel-cylinder gap closing mechanism of the improved revolver shown in FIG. 3.

The translatable shuttle (140) of the barrel-cylinder gap closing assembly (102) is shown in FIG. 8. The translatable shuttle (140) is comprised of a thin, hard, elastic metal or metal alloy having a cylindrical body (142) with a central bore (144). The overall dimension of the translatable shuttle (140) will vary depending upon the caliber of the cartridge (25) with which of the firearm (100) is to be used. However, it is thought that the translatable shuttle (14) will be sized to provide a desired annular space between said counterbore of said cartridge chamber and said cylindrical body (142) of said translatable shuttle (140).

Figure 9:
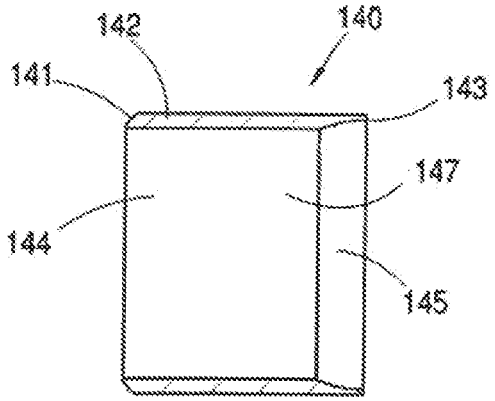
FIG. 9 is a cross-section view of the translatable shuttle of the barrel-cylinder gap cut along section 9-9 of FIG. 8.

As shown in FIG. 9, a cross-section view cut along section 9-9 of FIG. 8, the translatable shuttle (140) will preferably have an externally beveled front face (141) and a rear face (143). The beveled front face (141) of the translatable shuttle (140) extends around the exterior of the translatable shuttle (140) and will preferably be beveled for corresponding engagement with the leade (26) of the revolver barrel (14). The rear end (143) of the shuttle (140) may have an inwardly tapered conical surface (145) outwardly to facilitate the entry of a projectile (25) from an ammunition cartridge (20).

Figure 3:
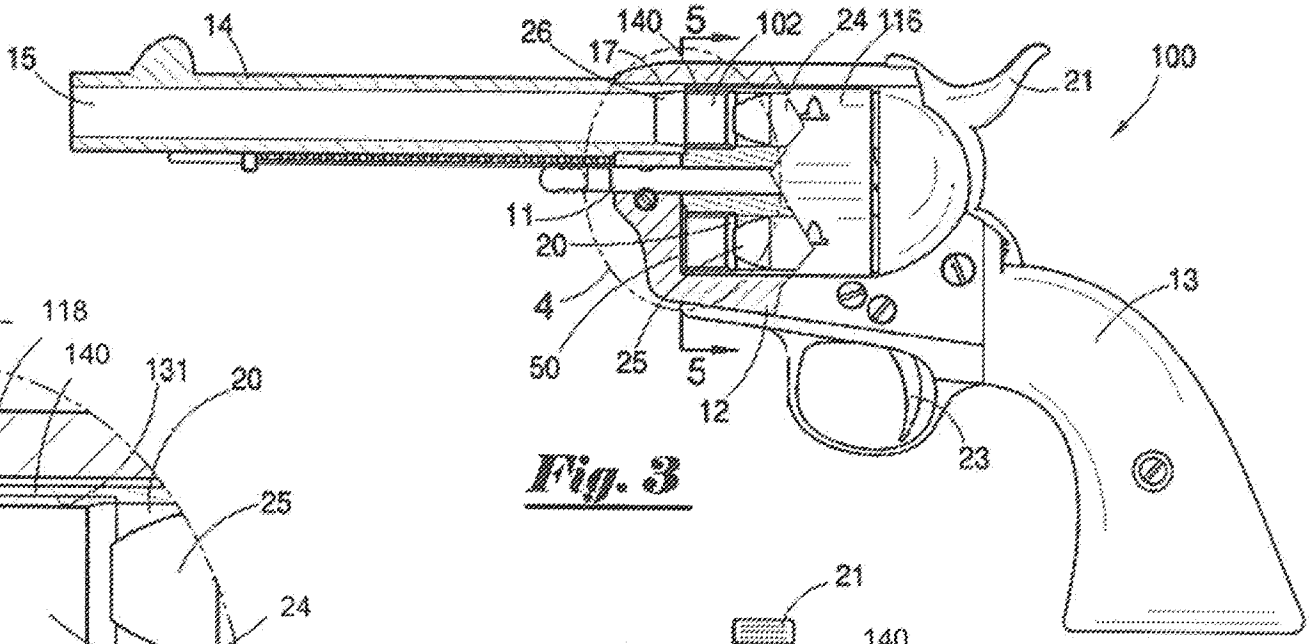
FIG. 3 is a partial cross-section side view of an embodiment of the improved revolver of Applicant's invention.

Rotation of the improved cartridge cylinder (116) about the cylinder pin (11) will position a selected counterbore (131), its retained translatable shuttle (140), its corresponding cartridge chamber (20), and, when the firearm (100) is loaded, its corresponding ammunition cartridge (24) in coaxial alignment with the barrel leade (26) at the breech-end (17) of the barrel bore (15) of barrel (14) as shown in FIGS. 3 and 4.

Figure 5:
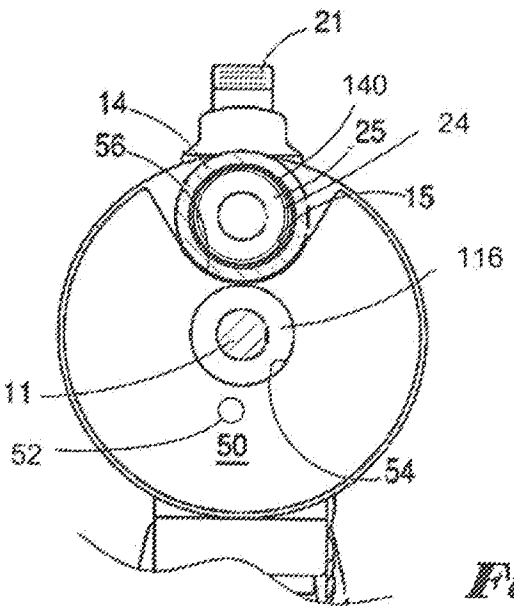
FIG. 5 is a cross-section view cut along section 5-5 of FIG. 3 showing frame end view of the improved cartridge cylinder and the shuttle retainer of the barrel-cylinder gap closing mechanism of the improved revolver shown in FIG. 3.
Figure 10:
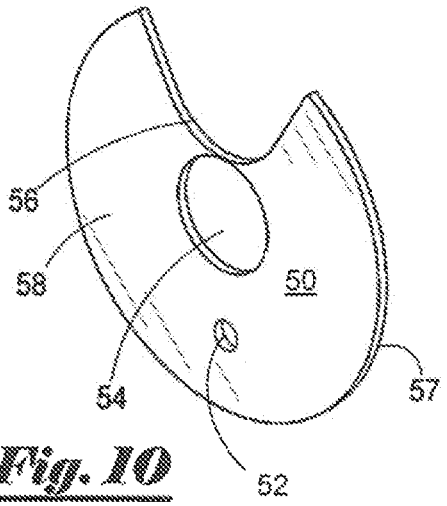
FIG. 10 is an isometric view of the shuttle retainer of the barrel-cylinder gap closing mechanism of the improved revolver shown in FIG. 3.
Figure 11:
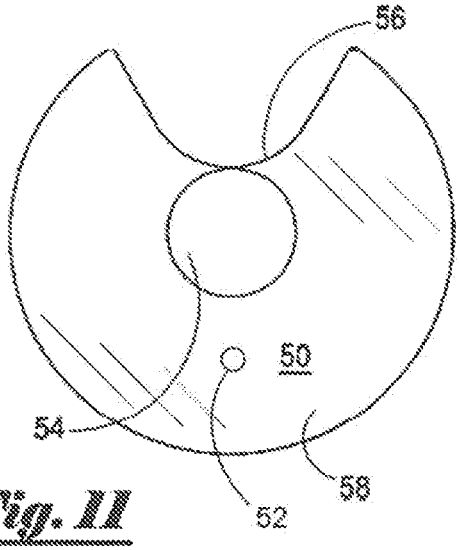
FIG. 11 is a front view of the frame face of the shuttle retainer of the barrel-cylinder gap closing mechanism of the improved revolver shown in FIG. 3.

The barrel-cylinder gap closing assembly (102) will also have a shuttle retainer plate (50) that is fixed to the frame (12) by at least one pin or threaded screw inserted in a corresponding pin bore (52) and positioned forward of the improved cartridge cylinder (116) as shown in FIG. 5. The shuttle retainer plate (50) serves as a retainer for the translatable shuttles (140). The shuttle retainer plate (50), shown in detail in FIGS. 10 and 11, has cylinder side face (57), a frame side face (58), and a central opening (54) so that the shuttle retainer plate (50) may be positioned on the frame (12) about the cylinder center pin (11) with the projectile recess (56) adjacent the breech-end (17) of the barrel (14).

The projectile recess (56) of the shuttle retainer plate (50) remains stationary on the frame (12) during rotation of the improved cartridge cylinder (116). The rotation of the improved cartridge cylinder (116) will align a selected cartridge chamber (20), its counterbore (131), its corresponding translatable shuttle (140), and its retained ammunition cartridge (24) with the projectile recess (56) of the shuttle retainer plate (50) and the breech-end (17) of the revolver barrel (14).

When the improved revolver (100) is fired, the expanding gases from the fired ammunition cartridge (24) will immediately create pressure within its corresponding cartridge chamber (20), corresponding counterbore (131), its aligned translatable shuttle (140), and the revolver barrel (14). of the cartridge cylinder (16). These pressures are concentrated on the wall (147) of the translatable shuttle (140) which serve to instantly expand the translatable shuttle (140) radially outward against the counterbore (131) and translate it forward to push the beveled front face (141) of translatable shuttle (140) against the tapered barrel leade (26) to provide a positive seal of the barrel-cylinder gap (119), i.e. the space (y) between the forward end (118) of the improved cartridge cylinder (116) and the barrel breech-end 17. This seal closes the barrel-cylinder gap (119) and prevents or substantially impedes the escape of gases, flames, and cartridge residue from the barrel-cylinder gap (119) when a cartridge (24) is fired.

Because of its elastic properties, the translatable shuttle (140) instantly contracts to its original size within the counterbore (131) as the pressure created from firing the ammunition cartridge (24) drops as the projectile (25) exits the revolver barrel (14). Rotation of the cartridge cylinder (116) after a cartridge is fired will engage the beveled front face (141) of the shuttle (140) with the barrel leade (26). This engagement will push or cam the shuttle (140) rearward to translate it back into the counterbore (131). This contraction and reward translation of the translatable shuttle (140) opens the barrel-cylinder gap (119) and allows the cartridge cylinder (16) to rotate freely within the frame (12) for a subsequent firing. Any forward translation of the translatable shuttles (140) in the counterbores (131) of the unfired cartridge chambers (20) that occurs as a result of firing recoil or other external forces will be restrained by the shuttle retainer plate (50) to retain these translatable shuttles (140) within their respective counterbores (131)).

Preferably, the translatable shuttle (140) will be manufactured from a suitable strong and elastic metal or metal alloy. It is thought that titanium, a titanium alloy, or another metal or metal alloy with elastic and hardness properties similar to titanium will be suitable for the manufacture of the breech seal (140). Titanium or a titanium alloy is thought to be a suitable material because it is very elastic material when compared to steel due to its lower Young's Modulus and because it displaces easily under pressure and reliably returns or 'springs' back to its original configuration when pressure in the counterbore is relieved. The use of titanium, a titanium alloy, or another metal or metal alloy with elastic and hardness properties similar to titanium for the translatable shuttle (140) will allow the shuttle body (142) to radially expand against the interior cylindrical wall (164) of the counterbore (131) as the translatable shuttle (140) translates forward. Such materials eliminate the necessity of O-rings or other sealing means.

The diameter, length, and sidewall dimension of the barrel (14), forcing cone or barrel leade (26) and angle β, counterbore (131), and shuttle (140) and other components of the improved revolver (100) will be sized depending upon the caliber of the ammunition cartridge (24) for which the of the improved revolver (100) is designed and the anticipated chamber pressures occurring when an ammunition cartridge (24) is fired.

The sealing of the barrel-cylinder gap (119) by the barrel-cylinder gap closing assembly (102) will also reduce barrel pressure losses and enhance the external ballistic performance of the cartridge projectile (25) as barrel pressure will be enhanced to propel the cartridge projectile (25) more effectively through the barrel (14). Similarly, if a sound suppressor is used with the revolver (100) with the barrel-cylinder gap closing assembly (102), the enhanced barrel pressure will help maintain the external ballistic performance of the cartridge projectile (25).

The sealing of the barrel-cylinder gap (119) by the barrel-cylinder gap closing assembly (102) of the improved revolver (100) will also upgrade the accuracy of the firearm because the engagement of the translatable shuttle (140) with the forcing cone or leade (26) will enhance the aligning the projectile (25) with the barrel (14) and reduce the wear and degrading of the forcing cone or leade (26) and increase the service life of the improved revolver (100).

Further, the sealing of the barrel-cylinder gap (119) by the barrel-cylinder gap closing assembly (102) of the improved revolver (100) will reduce the gritty residue of projectile particles and spent powder around the frame (12) and cartridge cylinder (16) and thus the frequency of firearm maintenance and cleaning.

Further, the sealing of the barrel-cylinder gap (119) by the barrel-cylinder gap closing assembly (102) of the improved revolver (100) will reduce or impede the creation of gritty residue to allow for more efficient rotation of the cartridge cylinder (116) as well as seal the barrel-cylinder gap (119) to reduce the firing noise and flash created when a cartridge (24) is fired and the incidence of flame-cutting of the revolver frame and other components.

Further, the seal the barrel-cylinder gap (119) by the barrel-cylinder gap closing assembly (102) will serve to maintain the pressure in barrel (14) to increase firearm performance including its performance when a sound suppressor is utilized.

It should be noted by those skilled in the art that the disclosures made herein are exemplary only. It will be evident that various changes may be made in the form, construction, and arrangement of the improved revolver and shuttle described herein, and the parts and components thereof, without departing from the spirit and scope of the invention or sacrificing its material advantages.

The invention claimed is:

1. An improved revolver firearm comprising:

(a) a barrel, said barrel having a breach-end with a conical leade;

(b) a rotatable cartridge cylinder, said cartridge cylinder having a forward end adjacent said conical leade of said barrel, said cartridge cylinder positioned to create a barrel-cylinder gap between said forward end of said cartridge cylinder and said breach end of said barrel;

(c) a plurality of cartridge chambers in said cartridge cylinder, each said cartridge chamber having a counterbore extending from said cartridge chamber to said forward end of said cartridge cylinder;

(d) a translatable shuttle positioned and translatably retained within said counterbore of each said cartridge chamber, wherein said translatable shuttles are translatable forward against said barrel leade thereby sealing said barrel-cylinder gap, said translatable shuttle having a cylindrical body comprised of hard elastic metal, a central bore, and a beveled front face, said beveled front face of said translatable shuttle configured to correspond with said conical barrel leade, wherein said counterbore of cartridge chamber and said translatable shuttle are configured to provide a radial space between said counterbore of said cartridge chamber and said translatable shuttle;

(e) a selected cartridge positioned within a selected cartridge chamber of said plurality of cartridge chambers, said selected cartridge chamber positioned adjacent said breach end of said barrel; and (f) wherein said cylindrical body of said translatable shuttle expands radially and translates forward against said barrel leade in response to pressure created within said cartridge chamber when said selected cartridge is fired.

2. The improved revolver firearm recited in claim 1 wherein said hard elastic metal comprises titanium.

3. An improved firearm comprising:

(a) a frame;

(b) a barrel supported on said frame, said barrel having a breech-end;

(c) a cartridge cylinder rotatably mounted within said frame adjacent said breech-end of said barrel whereby a barrel-cylinder gap between said cartridge cylinder and said breech-end of said barrel is created, said cartridge cylinder having a forward end and a rearward end, (d) a plurality of radially arrayed cartridge chambers extending from said rearward end of said cartridge cylinder, each said cartridge chamber having a forward end and a rearward end and a corresponding counterbore extending from said forward end of each said cartridge chamber to said forward end of said cartridge cylinder;

(e) a translatable shuttle positioned within each said corresponding counterbore of each said cartridge chamber of said cartridge cylinder, each said translatable shuttle having a cylindrical body comprised of hard elastic metal, a central bore, a forward end, and a rearward (f) an ammunition cartridge positioned within a selected cartridge chamber of said cartridge cylinder, said ammunition cartridge providing pressure within said selected cartridge chamber and said translatable shuttle when said ammunition cartridge is fire& and (g) whereby said translatable shuttle expands radially and translates forward from said corresponding counterbore of said selected cartridge chamber in response to said pressure to engage said breech-end of said barrel thereby sealing said barrel-cylinder gap.

4. The improved firearm recited in claim 3 wherein the dimensions of each said counterbore of each said cartridge chamber provides a desired space around the periphery of each said translatable shuttle.

5. The improved firearm recited in claim 4 wherein said translatable shuttle translates rearward in response to rotational engagement of said translatable shuttle with said breech-end of said barrel thereby opening said barrel-cylinder gap.

6. The improved firearm recited in claim 5 further comprising a retainer plate mounted to said frame whereby selected translatable shuttles are translatably retained within said corresponding counterbores of said selected translatable shuttles.

7. The improved firearm recited in claim 6 wherein said hard elastic metal comprises titanium.

8. The improved firearm recited in claim 7 wherein said forward end of said translatable shuttle is beveled.

* * * * *